US005465550A

United States Patent [19]

Dall'Omo

[11] Patent Number: 5,465,550

[45] Date of Patent: Nov. 14, 1995

[54] QUICK-RELEASE CONVEYING ARM IN MACHINES FOR ASSEMBLING AND WRAPPING PACKS OF ROLLS

[75] Inventor: Davide Dall'Omo, Bologna, Italy

[73] Assignee: Wrapmatic S.p.A., Bologna, Italy

[21] Appl. No.: 274,778

[22] Filed: Jul. 14, 1994

[51] Int. Cl.[6] ..... B65B 11/00; B65B 35/44; B65B 49/14

[52] U.S. Cl. ..... 53/233; 53/224; 53/257; 53/531

[58] Field of Search ..... 53/233, 224, 228, 53/223, 231, 466, 461, 257, 448, 443, 447, 531, 543, 439, 438, 436, 528, 529

[56] References Cited

U.S. PATENT DOCUMENTS

| | | | |
|---|---|---|---|
| 3,240,318 | 3/1966 | Mahaffy | 53/531 |
| 3,303,630 | 2/1967 | Harm | 53/443 |
| 4,505,093 | 3/1985 | Johnson | 53/531 |
| 4,689,934 | 9/1987 | Ganz | 53/233 X |
| 5,052,166 | 10/1991 | Ziegler et al. | 53/443 X |
| 5,287,679 | 2/1994 | Dall'Omo | 53/466 |
| 5,331,788 | 7/1994 | Cinotti | 53/528 X |

FOREIGN PATENT DOCUMENTS 1405929 9/1975 United Kingdom .

*Primary Examiner*—James F. Coan
*Attorney, Agent, or Firm*—Fay, Sharpe, Beall, Fagan, Minnich & McKee

[57] ABSTRACT

The conveying arm is composed of a first lower portion by which products assembled for wrapping are restrained, and a supporting upper portion embodied integrally with the first, which affords two slots occupying the full width of the arm as measured transversely to the conveying direction and designed to couple with two respective rails; the first such slot is located in and accessible from the face of the upper portion directed toward the products, and functions as a sliding bearing, whilst the second slot is located to the rear of the first. The arm is fashioned in a deformable material and its deformability enhanced by a narrow extension of the rear slot, in such a way that the upper portion can be locked to and released from the rail swiftly by applying a corresponding force parallel to the conveying direction.

5 Claims, 2 Drawing Sheets

QUICK-RELEASE CONVEYING ARM IN MACHINES FOR ASSEMBLING AND WRAPPING PACKS OF ROLLS

BACKGROUND OF THE INVENTION

The present invention relates to a conveying arm for fitment to automatic wrapping machines by which products, in particular rolls of toilet tissue and kitchen paper, are packaged in multiples.

In automatic machines of the type in question (the art field to which the present application refers, albeit with no limitation implied), household paper products are assembled typically in packs of two or four and wrapped in clear plastic (see also Italian patent application IT BOA91 000409) by a succession of stations, the first consisting in an elevator on which the rolls are positioned in pairs, arranged in tangential contact with their respective axes parallel and horizontally disposed; the rolls are lifted in this same configuration by the elevator, moving upwards and into a first wrapping station beneath which a sheet of plastic film is extended in readiness to be fashioned into a wrapper.

This forcible upward movement results in the rolls being enveloped initially from the side uppermost, an operation that occurs with the assistance of a restraint afforded by at least one pair of vertical arms between which the rolls remain supported as the elevator descends in readiness for a further lift stroke. The successive stations are equipped with horizontal folders and/or bottom restraints by which the sheet of plastic film is caused to assume a configuration completely enveloping the rolls and with the two longitudinal edges overlapping.

In effect, the vertical arms are associated rigidly with and suspended thus from a pair of transversely disposed horizontal rails, of which the ends are in their turn associated rigidly with trolleys secured bilaterally, in pairs, to the looped chains of an endless conveyor; the distance between centers of the pairs of arms determines the space afforded to the rolls, whilst the chains advance by discrete steps in such a manner as to transfer the assembled packs through the various wrapping stations.

On completion of the folding steps, all of which effected along a predetermined feed path, the pack of rolls will pause at a station where the bottom overlapping edges of the film are sealed together.

There is a drawback encountered in such machines, namely, the time-consuming nature of the changeover from one production size of pack to another. This operation centers particularly on the arms by which the packs of rolls are gripped and conveyed through the work stations, since the pack must be supported stably between the arms as previously intimated; in effect, the single arms are adjustable for position by hand in relation to the chains, along an axis disposed at right angles to the feed path followed by the packs and afforded by the transverse rails, to which the pairs of arms are secured by fastening means of releasable embodiment.

The operation in question must therefore be carried out on a significant number of arms, each of which needing to be released, repositioned and secured in its turn. Naturally, the time required to complete such a procedure is not inconsiderable, and has a negative impact on the productivity of the machine overall.

Accordingly, the object of the present invention is to overcome the drawbacks mentioned above by the adoption of a conveying arm featuring economy and simplicity in construction, which can be fitted to and adjusted on the rails with speed and precision.

SUMMARY OF THE INVENTION

The stated object is realized in a conveying arm according to the invention, which is designed for fitment to a wrapping machine typically as used in packaging rolls of household paper. Such machines comprise successive sets of arms by which the rolls are advanced along a given feed direction, the arms of each set serving to establish a plane disposed transversely to the feed direction and supported by a pair of horizontal rails which are spaced apart at a fixed distance between centers and extend transversely to the feed direction, suspended thus between looped conveying means in such a way that the arms can be advanced with the rolls through a succession of stations along the feed direction, during the course of which a wrapping is formed around the rolls.

Each arm is stably associated with and individually adjustable for position on the respective pair of rails.

The arm disclosed comprises a first active lower portion engaging in contact with the products, also a supporting upper portion permanently associated with the first portion and embodied with two slots occupying the full transverse width of the arm and serving to accommodate the rails; a first slot is located in the side of the upper portion facing the products and functions as a sliding bearing, whilst the remaining slot is located in the part of the upper portion to the rear of the first slot.

To advantage, each arm further comprises means designed to afford enhanced elastic deformability, incorporated into the upper portion and acting on the slots at least in a direction parallel to the feed direction, in such a way that the arm can be secured stably to and released from the relative pair of rails by a simple forcing movement for the purposes of adjusting its position.

BRIEF DESCRIPTION OF THE DRAWINGS

The invention will now be described in detail, by way of example, with the aid of the accompanying drawings, in which.

DESCRIPTION OF THE PREFERRED EMBODIMENTS

With reference to the accompanying drawings, the conveying arm disclosed is designed for application to machines by which single products, illustrated as rolls of toilet tissue or kitchen paper in the example of the drawings, are assembled and wrapped in multiple packs.

Figure 1:
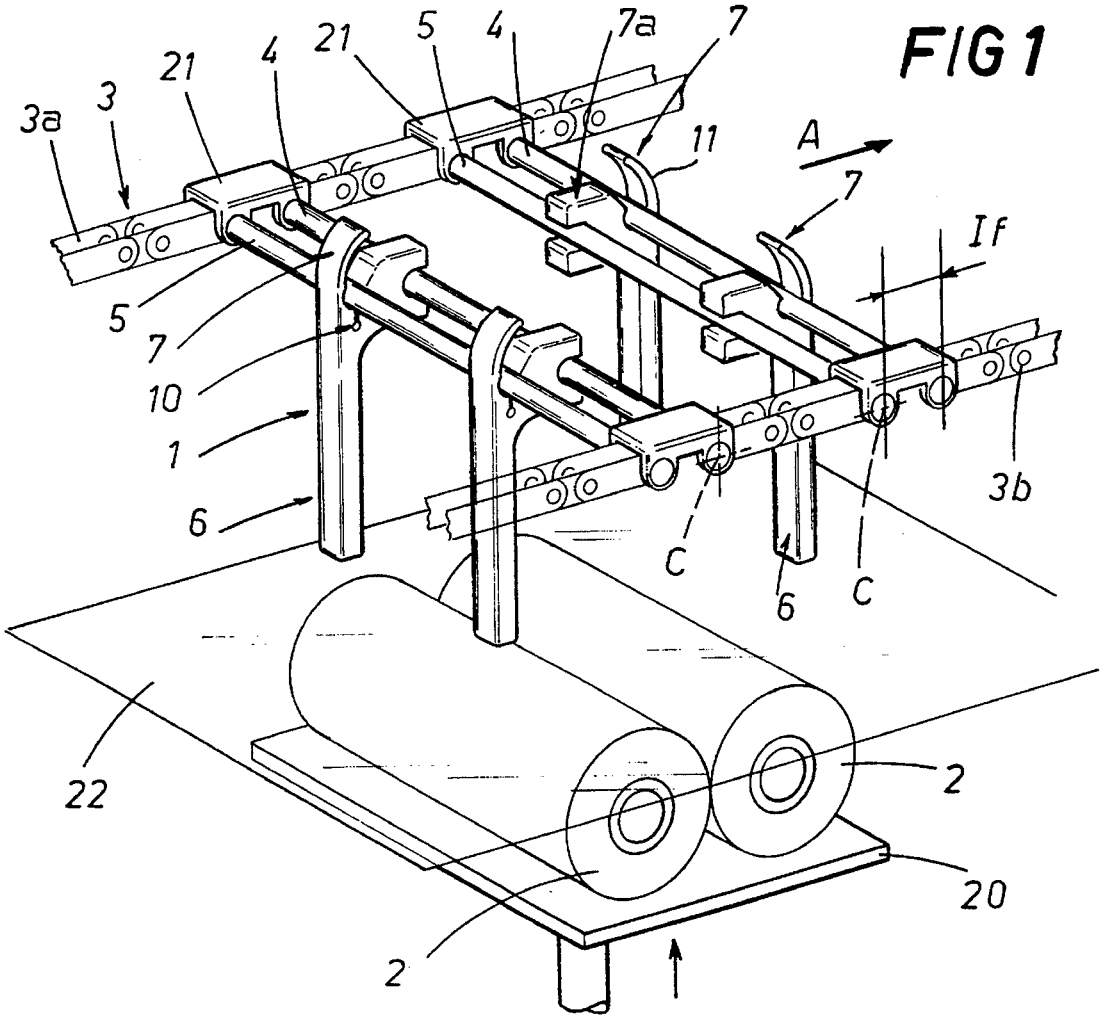
FIG. 1 illustrates two pairs of conveying arms according to the invention, installed in a machine for assembling and wrapping packs of products, seen in a perspective view with certain parts omitted better to reveal others.

As discernible in FIG. 1, such machines comprise, amongst other features, successive pluralities of arms 1 by which products 2 taken up from beneath at an infeed station 20 (an elevator of conventional embodiment) are advanced along a feed direction denoted A (which is horizontal, in the example of the drawings). Whilst reference is made throughout the specification to pairs of arms 1, the plurality of arms might equally be more than two in number, positioned one alongside the next, inasmuch as the number in question will depend on the dimensions of the products 2 measured in the direction transverse to the feed direction.

The arms 1 of each pair serve to define a plane P disposed transversely to the feed direction A, and are associated permanently with endless conveying means 3 embodied as a pair of chains 3*a* and 3*b* looped around a pair of power driven pulleys or sprockets (not illustrated). Each pair of arms 1 is positioned facing a successive pair positioned at a prescribed distance along the feed direction A, in such a manner that the incoming group of products 2 will be securely retained (see FIG. 1).

More precisely, each arm 1 is associated with a relative pair of horizontally disposed and mutually parallel rails 4 and 5, and adjustable for position thus along an axis B disposed transversely to the feed direction A; the two rails 4 and 5 are spaced apart at a given distance between centers If, and associated rigidly by their ends with a respective pair of trolleys 21 secured to the chains 3*a* and 3*b* one on either side.

The chain loops 3*a* and 3*b* rotate in such a way that the products 2 are carried forward by the arms 1, already in the packaged format and associated with a sheet of wrapping film 22, through a succession of work stations (not indicated, being conventional in embodiment and not central to the invention) and along the horizontal feed direction A, during the course of which the packs of products 2 are wrapped and sealed.

Figure 4:
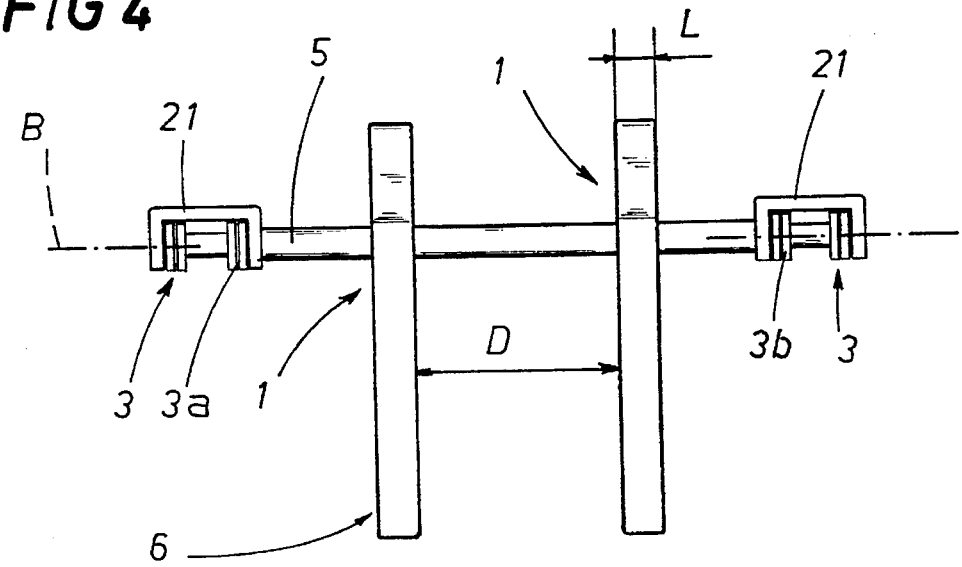
FIG. 4 illustrates a pair of conveying arms as in FIG. 1, viewed in a frontal elevation from the rear.
Figure 2:
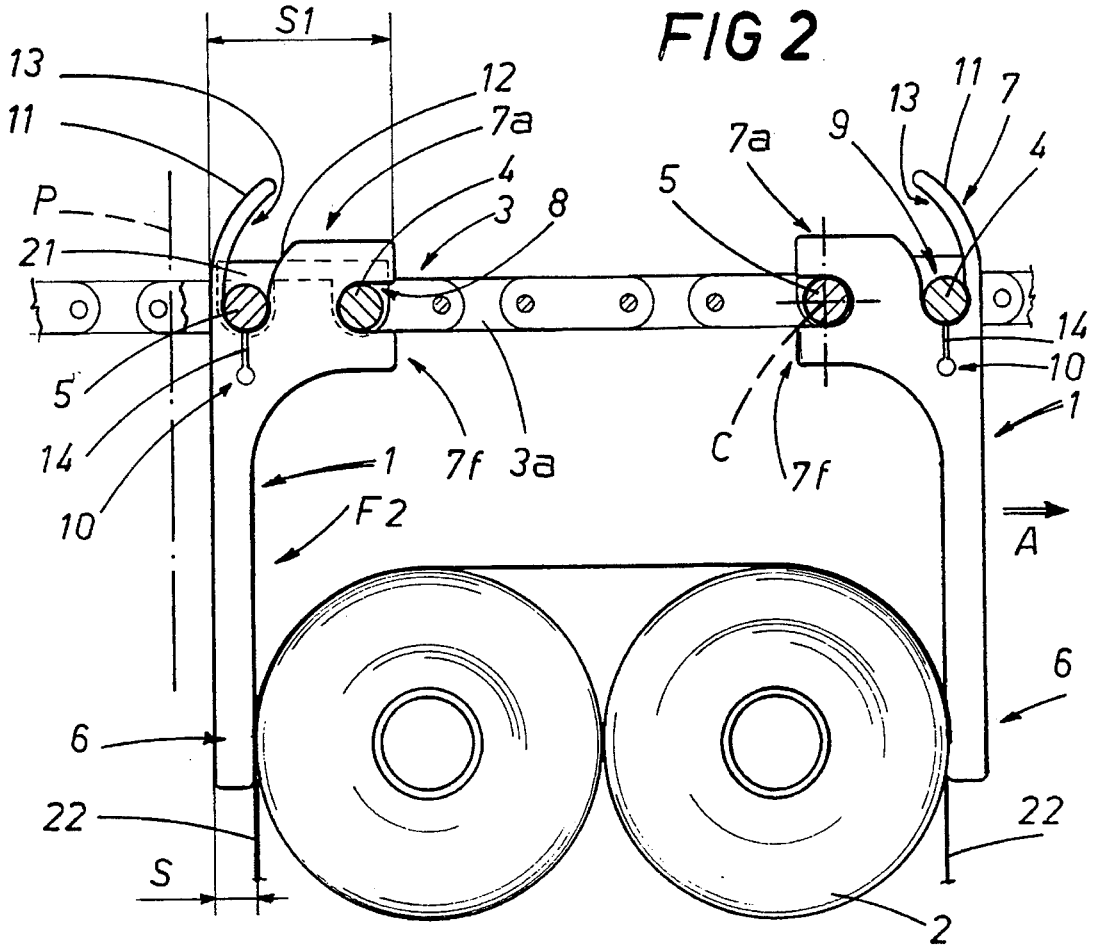
FIG. 2 illustrates the conveying arms of FIG. 1 in an operating position, enlarged and viewed in a side elevation, with certain parts omitted better to reveal others.
Figure 3:
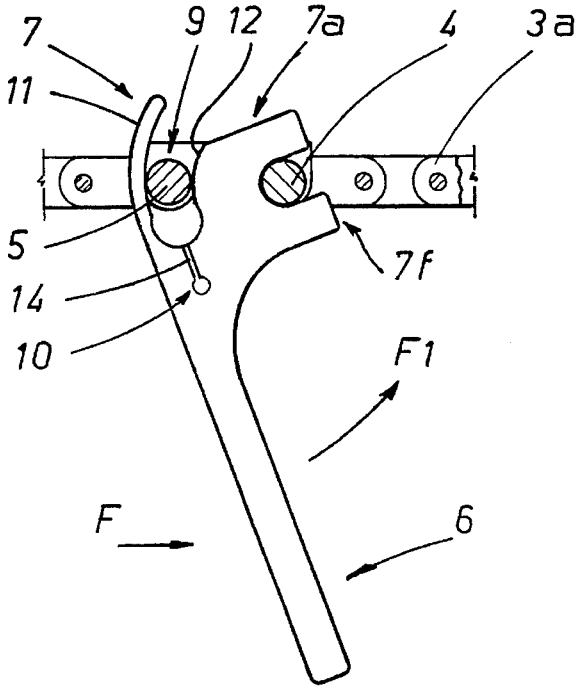
FIG. 3 illustrates a conveying arm as in FIG. 1, in a non-operating position, enlarged and viewed in a side elevation with certain parts omitted better to reveal others.

As discernible in FIGS. 2 and 3, each arm 1 consists in a first active lower portion 6 and a supporting upper portion 7, which might be embodied integrally with no break in continuity as illustrated in the drawings: the depth S of the lower portion 6 will be seen in FIG. 2 to be less than the depth S1 of the upper portion 7, so that the arm 1 exhibits an upturned "L" shape overall when viewed in section. More exactly, it is the active lower portion 6 that grips and conveys the products 2, whilst the upper portion 7 affords two open slots 8 and 9 occupying the full width L of the arm as measured along the transverse axis B (FIG. 4).

The two slots 8 and 9 serve each to accommodate a corresponding rail 4 or 5, the one located in and accessible from the front face 7*f* of the upper portion 7 on the side offered to the products 2, and the other occupying the rear part of the upper portion 7. In practice, the first slot 8 affords a bearing by which the arm 1 is supported slidably on the relative rail 4 or 5, whilst the second slot 9, which is embodied with means 10 affording enhanced elastic deformability, can be clipped stably onto and released from the relative rail 5 or 4.

To enable the aforementioned clipping and removal operations, the rear slot 9 is accessible from between the topmost face 7*a* of the upper portion 7 and a substantially vertical member 11 of arcuate profile that extends upward from the slot 9 and combines with a mutually opposed rounded profile 12 of the topmost face 7*a* to create a correspondingly arcuate guidance and access passage 13 leading into the slot 9. The arc of the passage 13 is centered on the axis C of rotation of the front slot 8, which is concurrent with the axis denoted B.

The aforementioned means 10 affording enhanced elastic deformability consist partly in a vertical notch 14 cut in the stopped end of the rear slot 9 and emerging directly onto the relative surface in such a manner as to facilitate the operations of clipping and removing the upper portion 7 onto and from the relative rail 5 or 4 when a force F is applied to the arm in a direction parallel to the feed direction A.

Also forming a part of the means 10 for enhancing elastic deformability is the structure of the arm 1 itself, inasmuch as the two component portions 6 and 7 are embodied integrally and fashioned from a plastic material (e.g. nylon), thereby increasing the flexibility of the slots 8 and 9 when the arm is secured to and released from the rails 4 and 5.

A machine fitted with the arm 1 thus described can be rearranged by the operator to handle a new pack size in markedly simple fashion: with the machine at standstill and the pair of arms 1 secured at a given distance D one from the other (see FIG. 4), the operator need do no more than push the lower portion 6 of each arm (or of one arm only) in the direction denoted F, applying a force greater than that with which the rail 5 or 4 is restrained in the slot 9, in such a way as to release the upper portion 7 from the rail 5 (FIG. 3) and allow its rotation in the direction denoted F1; thereafter, with the arm 1 now free to slide along the rails 4 and 5, the operator adjusts the distance between the two arms of the pair by a prescribed quantity (which might be checked by means of a template or similar indicating means). With the repositioning completed, the operator secures the arm 1 in place by restoring the stable association between the rail 5 or 4 and the rear slot 9, rotating the arm about the front slot 8 (axis C) in the direction F2 opposite to that which produces its release, the relative movement being guided by the passage 13. Clearly, the conveying arm thus embodied allows a swift, simple and secure adjustment, thanks to its maneuverability and to the particular geometry of the slots, which guarantee a secure locking and releasing action in combination with the rails; finally, the solution disclosed is one affording significant advantages of economy.

What is claimed is:

1. A quick-release conveying arm in a machine for assembling and wrapping products in multiple packs comprising successive pluralities of arms by which the products are advanced along a predetermined feed direction, the arms of each such plurality serving to establish a plane disposed transversely to the feed direction and supported by a pair of horizontal rails spaced apart at a fixed distance between centers and extending transversely to the feed direction, suspended between looped conveying means in such a way that the arms can be advanced with the products through a succession of stations along the feed direction during the course of which the assembled products are wrapped, each arm stably associated with and singly adjustable for position on the relative pair of rails, wherein each arm comprises a first active lower portion engaging in contact with the products, also a supporting upper portion permanently associated with the first portion and embodied with two slots occupying the full width of the arm as measured transversely to the feed direction and serving to accommodate the pair of rails, of which a first slot is located in and accessible from the side of the upper portion facing the products and provides a slidable means of supporting the arm, whilst the remaining slot is located in the rear part of the upper portion; each arm further comprising means serving to afford enhanced elastic deformability, incorporated into the upper portion and acting on the slots at least in a direction parallel to the feed direction, in such a manner as will allow the arm to be secured stably to and released from the relative pair of rails for the purposes of repositioning.

2. A conveying arm as in claim 1, wherein the rear slot is accessible from between the top face of the upper portion and an essentially vertical member of arcuate profile extending upward from the slot and combining with a mutually opposed rounded profile of the top face to create an arcuate guidance and access passage leading into the rear slot, of which the curvature is centered on an axis of rotation concurrent with the axis of the first slot.

3. A conveying arm as in claim 1, wherein the means affording enhanced elastic deformability comprise a vertical notch cut in the stopped end of the rear slot and emerging onto the corresponding internal surface of the slot, in such a way that the rear slot and the relative supporting rail can be locked and released deformably to and from one another.

4. A conveying arm as in claim 1, wherein the active lower portion and the supporting upper portion are embodied integrally and fashioned from a plastics material.

5. A conveying arm as in claim 1, wherein the depth of the active lower portion as measured parallel with the feed direction is less than the corresponding depth of the supporting upper portion, such that the arm exhibits a substantially upturned-L profile when viewed transversely to the feed direction.

* * * * *